US005913512A

United States Patent [19]

Fritsche et al.

[11] Patent Number: 5,913,512

[45] Date of Patent: Jun. 22, 1999

[54] DEVICE FOR SEPARATING FLAT OBJECTS WHICH ARE SUPPLIED IN STACKED FORM

[75] Inventors: Beat Fritsche, Greifensee; Peter Schmid, Neuhausen; Jean-Claude Oppliger, Niederhasli, all of Switzerland

[73] Assignee: Grapha-Holding AG, Hergiswil, Switzerland

[21] Appl. No.: 08/704,521

[22] PCT Filed: Jan. 5, 1996

[86] PCT No.: PCT/CH96/00004

§ 371 Date: Sep. 12, 1996

§ 102(e) Date: Sep. 12, 1996

[87] PCT Pub. No.: WO96/22242

PCT Pub. Date: Jul. 25, 1996

[30] Foreign Application Priority Data

Jan. 16, 1995 [CH] Switzerland ..... 00114/95

[51] Int. Cl.[6] ..... B65H 5/00

[52] U.S. Cl. ..... 271/10.06; 271/34; 271/121; 271/150

[58] Field of Search ..... 271/10.06, 34, 271/35, 149, 150, 121, 167

[56] References Cited

U.S. PATENT DOCUMENTS

| | | | |
|---|---|---|---|
| 3,988,017 | 10/1976 | Kyhl | 271/10.06 X |
| 4,302,000 | 11/1981 | Frank | 271/150 |
| 4,634,111 | 1/1987 | Frank | 271/34 |

FOREIGN PATENT DOCUMENTS

| | | | |
|---|---|---|---|
| 0191351 | 8/1986 | European Pat. Off. . | |
| 0215469 | 3/1987 | European Pat. Off. . | |
| 0423664 | 4/1991 | European Pat. Off. . | |
| 0525582 | 2/1993 | European Pat. Off. . | |
| 0589789 | 3/1994 | European Pat. Off. . | |
| 1068162 | 6/1954 | France . | |
| 1170971 | 5/1964 | Germany . | |
| 1536710 | 2/1970 | Germany . | |
| 2209427 | 10/1973 | Germany . | |
| 60-232337 | 11/1985 | Japan . | |
| 1348733 | 3/1974 | United Kingdom | 271/149 |

*Primary Examiner*—David H. Bollinger
*Attorney, Agent, or Firm*—George H. Spencer; Robert Kinberg

[57] ABSTRACT

A device for separating flat objects includes an endless conveyer belt on which the flat objects are supplied standing on edge and forming a stack. A conveying device including a rotating conveying element picks up the objects individually on the flat side from a front of the stack by a run of the rotating conveying element which removes the flat objects crosswise relative to the stack. The conveying device includes a guide arrangement for displacing the conveying device through a stroke approximately parallel to a direction in which the stack is formed while bearing on the front end of the stack.

16 Claims, 2 Drawing Sheets

DEVICE FOR SEPARATING FLAT OBJECTS WHICH ARE SUPPLIED IN STACKED FORM

BACKGROUND OF THE INVENTION

The invention relates to a device for separating flat objects, such as envelopes, letters, mailing envelopes, pouches, printed pages or the like, supplied in stacked form and standing, to a rotating transport means, consisting of a conveyor device, which grasps the objects individually on the flat side and removes them crosswise to the stack forming direction, one by one from the front of the stack with the aid of a belt run of a rotating conveying element.

A device of this kind is disclosed in European patent documents EP-A-0 191 351, 0 215 469, 0 423 664, 0 525 582 and 0 589 789. EP-A-0191 351 relates to a separator of flat objects with varied physical characteristics, which range over a broad spectrum, wherein a feeding station is provided for a stack of the objects and a removal station for the individual objects. A separating station is arranged in-between, which grasps the objects at the stack front and places them crosswise in the removal station. For this purpose, the aforementioned reference provides that the stacks formed vertically to the separating direction are moved by means of fingers or carriers that can be swiveled in from the side to the separating station, where the first article in the base area hits a low stop. The article is displaced to the removal station located on the side with an oscillating drive intake device that is guided toward the first article. This removal station consists of an endlessly rotating conveyor belt with openings, behind which a vacuum chamber is arranged at the trajectory for the removed objects. By operating jointly with the openings in the conveyor belt, this vacuum chamber holds the article, located on the opposite side, against the conveyor belt.

EP-A-0 215 469 relates to an installation for marking flat objects, in particular postal shipments, which affixes coded information to the flat objects in accordance with the address information written on the objects and which has a manual encoding station for this purpose. Connected to this installation is also a device for separating, with which the objects that arrive in stacked form are removed with their front end from the stack with an evacuating conveying element—a roller or belt—and are pushed from the side into a conveying device. To be sure, this concerns an intermittent feeding and processing of the stacks, which are supplied by a moving rear wall of the magazine of the separating device from which the objects are to be removed, wherein once the magazine is emptied, this rear wall is moved back to the starting position to be refilled.

Similar devices are shown in EP-A-0 525 582 and 0 589 789.

The devices described in the aformentioned references, do not have arrangements that satisfy an uninterrupted processing of the objects, which have varied formats and thicknesses.

Not only do these known devices lack a reliable operation with respect to all connected movements at the place where the objects are taken up, but they also do not function well in the area of the transfer from the separating station to the continued transport.

SUMMARY OF THE INVENTION

An object of invention is therefore to produce a device of the aforementioned type, with which the reliability of processing and thus also the capacity can be improved in a simple way.

The solution according to the invention is that the conveying device is driven with the aid of a guiding device approximately parallel to the stack forming direction such that the conveying device is displaceable while bearing against the front end of the stack, which is supported at the rear.

Such a design permits a continuous processing of flat objects of varied size.

It is of advantage if the movements of the conveying device are limited by stops, which make it possible to influence the delivery position of the objects.

It is preferable if the conveying device is mounted to a frame that can be propelled and can be incorporated as part of the guiding device.

The frame is also suitable as a connecting component to a load that generates the driving power.

In order to favor the separating process, a stripper roller is coordinated with the belt-type conveying element, which rotates in the same direction and with the latter forms a feeding gap for the taken-up objects. This stripping roller also helps stabilize the objects during the separating process.

A stationary guide aiding the intake process of the objects is installed in front of the stripping roller, which is propelled by the objects, that is at the feed-in end of the feeding gap on the side that faces away from the conveying element.

This guide can also be designed such that it can be adjusted relative to the stripping roller in order to change the intake gap.

That is why the stripping roller and/or the guide are designed such that they can be displaced either toward the conveying device or away from it and/or the intake angle can be changed, so that the intake gap can be adjusted to the intake conditions.

It is advantageous if the feeding movement of the stripping roller and/or the guide element takes place with the aid of an energy accumulator, against which the aforementioned elements retreat upon impact of an article removed from the stack.

The movement direction of the stripping roller relative to the conveying element is suitably selected such that it encloses a sharp angle with the latter or the belt run of the conveying element, which serves to dampen the blows caused by the impact of the arriving objects.

In order to achieve the approach movement—in one of the end positions of which the stripping roller is at least approximately next to the conveying element—it is advantageous to provide a linear guide or longitudinal guide, which reacts swiftly and exactly.

For this, the linear guide is designed to have two parallel guide elements that are mounted on a support at a distance to each other and on which a bearing block, holding the arranged stripping rollers, is installed such that it can be moved.

The approach force of the stripping roller toward the conveying element can be generated by installing the energy accumulator between support and bearing block, for example with the aid of a compression spring.

A mostly uninterrupted separation of the objects transported in a stack can be achieved only if the transporting means is connected to a control device for determining the feeding speed of the objects, depending on the stroke position of the conveying device or the conveying element, so that an automatic regulation effect occurs during the stacking process.

In order to be able to feed flat objects to the conveying device without interruption, it is advisable if the belt-type transporting means is equipped with immovably installed carriers that follow at intervals and form alternate inserting compartments, and which have a recess in the operating range of the conveying element to be passed.

The recesses, which extend to the rotating transport belt above the conveying element, affect the fastening options for the carriers along the transport belt, in that the carriers are connected to the transporting means with a fastening device that adjoins the recess.

It is also recommended that the transporting compartments formed by the carriers are closed off on one side by a stationary wall that forms a constant stop edge for the objects and ends in front of the conveying element, so that the objects to be delivered always hit at the same spot of the conveying element.

BRIEF DESCRIPTION OF THE DRAWINGS

The invention is explained in the following by referring to the drawing, to which reference is also made for all details not explained in the description. Shown in the drawing are.

DETAILED DESCRIPTION OF THE INVENTION

Figure 1:
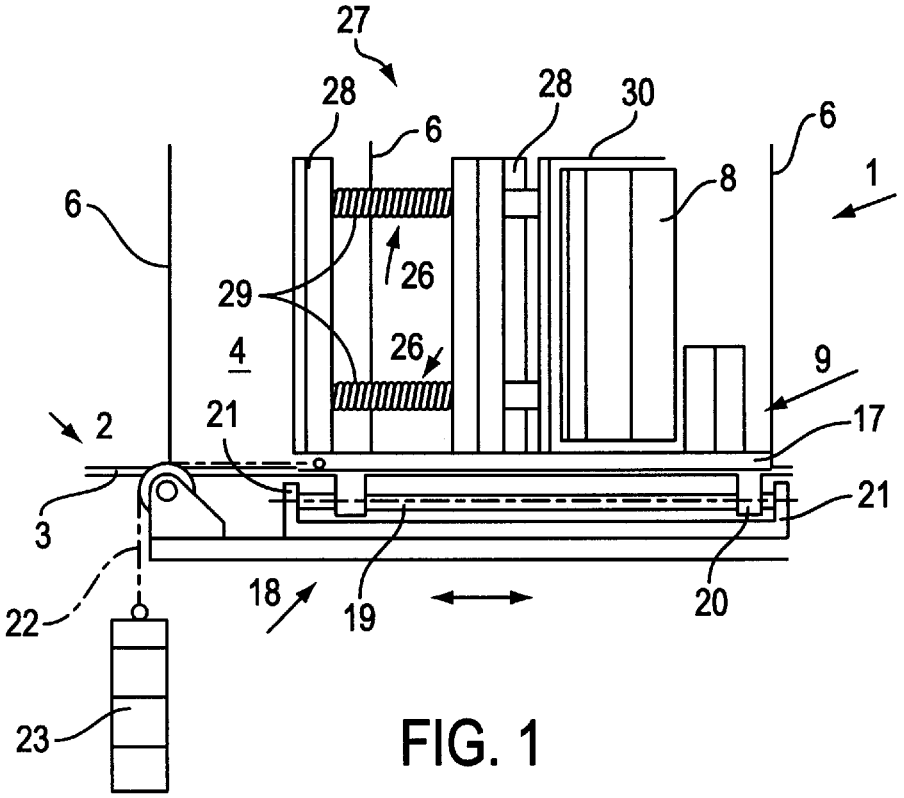
FIG. 1 is a view from the side of a device according to the invention, for separating flat objects supplied in stacked form.
Figure 2:
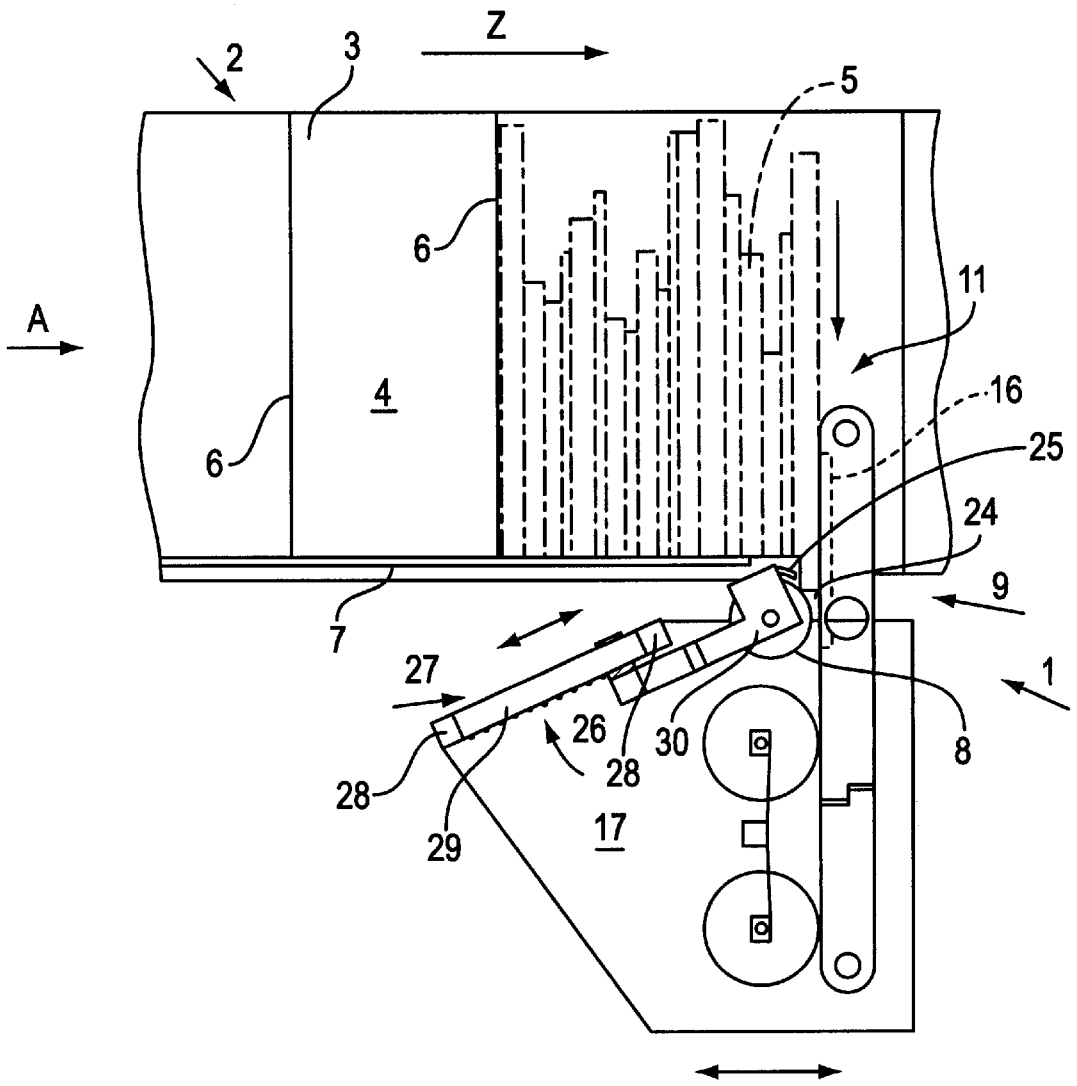
FIG. 2 is a view from above the device shown in FIG. 1.

FIGS. 1 and 2 show a device 1 for separating flat objects 5, such as postal shipments in the form of envelopes, letters, mailing envelopes, pouches, printed pages, packages or the like, which are supplied in stacked form and standing on a rotating transporting means 2. The transporting means 2 furthermore has an endless conveying belt 3 or side-by-side installed conveying belts. Compartments 4 for the objects 5, which are supplied in stacked form, are formed by carriers 6 that are mounted on belts 3 in such a way that they extend across the conveying width and follow at intervals. The drawing shows a transport compartment 4 that is filled completely with objects 5 behind a transport compartment which has already been subjected to the separating process.

A wall 7 is provided in the supply direction—arrow Z—for objects 5, on the side of transport means 2, and sticks up directly in front of the conveyor belt 3, extending to a subsequently described stripping roller 8, which operates jointly with the conveying device and forms a stopping edge for positioning the objects 5. The objects 5 are gripped on the front edge of a supplied stack 11 by a conveying element 10 of the conveying device 9 and are pulled off to the side.

The conveying element 10 or the conveying device 9 for this purpose leans against the front end of stack 11, so that the required seal necessary for pulling off the front object 5 with a vacuum source 15 can develop in such a way that a correct separation takes place.

Figure 3:
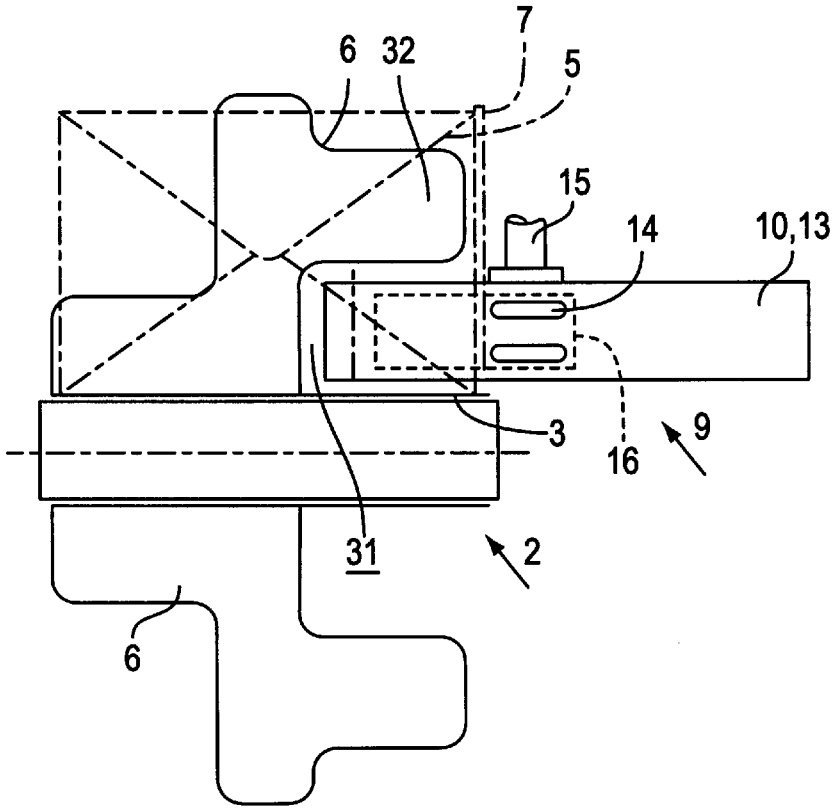
FIG. 3 is a view of the device according to arrow A in FIG. 2.

The conveyor element 10 is a conveyor that circulates around vertical rollers, for which the belt run 13 that is facing the objects 5, supplied by the transporting means 2, has two recesses 14 one above the other, which make contact intermittently with a vacuum source 15 arranged behind the run 13 (see also FIG. 3). A vacuum chamber needed for this is indicated with dashed line 16 in FIGS. 2 and 3.

The conveying element 10 bears against the stack front as a result of a stroke like follow-up effect of the conveying device 9, which is fastened for this purpose on a parallel movable frame 17, which can be moved parallel to supply direction Z. The latter can be guided along rails, as well as by means of a guide arrangement 18—as shown—which consists of at least one guide rod 19 and a sliding sleeve 20 connected to frame 17 and adjusted by sliding it along guide rod 9. Stops 21 are installed at the ends of the guide arrangement, which limit the stroke movements of the conveying device 9 or the conveying element 10. The displacement of conveying device 9 takes place with a load 23 suspended from rope 22, which is deflected around a roller and is connected to the frame 17, but could also be achieved with a motor or with an accumulator. By changing the load 23, the pressure exerted by conveying device 9, which is achieved by bearing against the stack 11, can be varied.

A purposeful follow-up and adjustment of conveying element 10 to the stack dimensions is achieved with a non-depicted control device, which influences or controls the speed at which the objects 5 are supplied, depending on the stroke or excursion position of the conveying device 9 in the guide arrangement 18.

The stripping roller 8, which operates jointly with the conveying element 10, is attached to frame 17. This stripping roller 8, which can be activated only by being acted upon by an object, forms an intake gap 24 together with the conveying element 10 and on the basis of the rotation in the same direction.

At the feed-in end of the intake gap 24, a guiding element 25 is provided at a distance from stripping roller 8, which guiding element supports the intake of the individual objects 5 into the intake gap 24. The guiding element 25 can be designed as a sheet metal strip that is installed in front of stripping roller 8 in conveying direction and extends over its effective width and which encloses an intake angle of approximately 45° together with conveying element 10, which not only results in a gentle intake, but also makes it possible to avoid a jamming of the objects in front of the intake gap 24.

Stripping roller 8, which can be advanced toward the conveying element 10 following the pick-up and separating place for the objects 5, is drive-connected to an energy accumulator 26. Its movement direction forms a sharp angle together with the conveying direction of conveying element 10.

The stripping roller 8 is for this purpose connected to a linear guide 27 that is attached to the frame 17 and is formed by two guide elements 29 that are attached to supports 28 spaced at a distance to each other. A bearing block 30 for stripping roller 8 is installed movably on guide elements 29. The energy accumulator 26, formed by compression springs, is arranged on the guide elements 29 between one support 28 and bracket 30 for the stripping roller 8.

FIG. 3 illustrates the design for the carriers 6. These have a recess 31 in the area facing the take-off conveying element 10 and are tightly connected to the conveying belt 3 by way of the part adjoining on the side.

The segment 32 that projects in the center of the carriers 6 serves as supporting device for the total height of the objects 5.

We claim:

1. An arrangement for separating flat objects each having an edge and a flat side, comprising:

an endless transporting means on which the flat objects are supplied standing on their edges and forming a stack; and a conveying device operatively arranged with the endless transporting means and including a rotating conveying element for picking up the objects individually on the flat side from a front end of the stack by a run of the rotating conveying element and which removes the flat objects crosswise relative to the stack, wherein the conveying device includes a guide arrangement for displacing the conveying device through a stroke approximately parallel to a direction in which the stack is formed while bearing on the front end of the stack.

2. The arrangement according to claim 1, wherein the guide arrangement includes stops for limiting the stroke of the conveying device.

3. The arrangement according to the claims 1, further including a frame to which the conveying device is connected and which can be displaced with the conveying device.

4. The arrangement according to claim 3, wherein the frame is connectable to one of a load, pressure accumulator and a motor for generating a drive power for displacing the frame.

5. The arrangement according to claim 4, wherein the rotating conveying element comprises a rotatable belt, and the arrangement further includes a stripping roller coordinated with the conveying element, rotatable in the same direction as the rotatable belt and, together with the rotatable belt forms an intake gap through which the flat objects pass during a separation process.

6. The arrangement according to claim 5, wherein the intake gap has a feed-in end and has on one side a guide element that is installed before the stripping roller and forms a sharp angle with the conveying element.

7. The arrangement according to claim 6, wherein at least one of the stripping roller and the guide element are movable toward and away from the conveying device and form an adjustable intake angle with the conveying device.

8. The arrangement according to claim 7, further including an energy accumulator drive connected to the stripping roller for biasing the stripping roller in a direction of an approach movement of the stripping roller toward the conveying device.

9. The arrangement according to the claim 8, wherein a movement direction for the stripping roller and a conveying direction for the conveying device form a sharp angle.

10. The arrangement according to the claim 9, further including a linear guide attached to the frame, the stripping roller being connected to the linear guide.

11. The arrangement according to claim 10, further including a bearing block mounting the stripping roller, and wherein the linear guide includes a support and at least two guide elements arranged on the support at a distance to each other and on which the bearing block for the stripping roller is arranged such that it can be moved.

12. The arrangement according to claim 11, wherein the energy accumulator is arranged between support and the bearing block.

13. The arrangement according to claim 1, further including a control device having a drive connected to the transporting means and determining a speed at which the objects are supplied to the conveying device in dependence of a stroke position of the conveying device.

14. An arrangement for separating flat objects each having an edge and a flat side, comprising:

an endless transporting means comprising a belt on which the flat objects are supplied standing on edge and forming a stack; and a conveying device operatively arranged with the endless transporting means and including a rotating conveying element for picking up the objects individually on the flat side from a front of the stack by a run of the rotating conveying element and which removes the flat objects crosswise relative to the stack, wherein the stack of flat objects has a back end and the endless transporting means further includes a plurality of carriers rigidly attached at intervals to the rotating conveying element, wherein a segment of the rotating conveying element which takes up the objects is arranged above the belt and the carriers each have a recess in an operational range of the rotating conveying element.

15. The arrangement according to claim 14, wherein the carriers include a fastening device for fastening the carriers to the belt following the recess.

16. The arrangement according to claim 15, wherein the carriers form transport compartments for the flat objects, and further including a fixed wall closing off one side of the compartments, the fixed wall ending in front of the conveying element and running parallel to a direction in which the flat objects are supplied by the transporting means.

* * * * *